US008082936B2

(12) United States Patent
Goldberg et al.

(10) Patent No.: US 8,082,936 B2
(45) Date of Patent: Dec. 27, 2011

(54) WALKING CANE

(75) Inventors: Ronald M. Goldberg, North Bergen, NJ (US); Joseph Goldberg, Easton, CT (US)

(73) Assignee: Kineticane, LLC, New York, NY (US)

( * ) Notice: Subject to any disclaimer, the term of this patent is extended or adjusted under 35 U.S.C. 154(b) by 0 days.

(21) Appl. No.: 12/893,951

(22) Filed: Sep. 29, 2010

(65) Prior Publication Data

US 2011/0073144 A1 Mar. 31, 2011

Related U.S. Application Data

(60) Provisional application No. 61/246,776, filed on Sep. 29, 2009.

(51) Int. Cl.
*A45B 9/02* (2006.01)

(52) U.S. Cl. ..... 135/76; 135/72

(58) Field of Classification Search ..... 135/65, 135/72, 76; 16/421, 430, 436, 440, 444, 16/426, DIG. 12, DIG. 19, DIG. 24, 431; 294/57

See application file for complete search history.

(56) References Cited

U.S. PATENT DOCUMENTS

| | | | | | |
|---|---|---|---|---|---|
| 596,203 | A | * | 12/1897 | Drake | 135/69 |
| 705,741 | A | * | 7/1902 | Drew | 135/69 |
| 0,765,984 | A | | 7/1904 | Morris et al. | |
| 904,481 | A | * | 11/1908 | Hood | 135/69 |
| 1,358,643 | A | * | 11/1920 | Lamming | 135/72 |
| 1,400,600 | A | * | 12/1921 | Glowacki | 135/72 |
| 1,446,009 | A | * | 2/1923 | Glowacki | 135/72 |
| 2,172,047 | A | | 9/1939 | Jacobucci | |
| 2,802,479 | A | | 8/1957 | Hickman | |
| 3,269,399 | A | | 8/1966 | Smith | |
| 3,517,678 | A | * | 6/1970 | Gilsdorf | 135/72 |
| 3,995,650 | A | | 12/1976 | DiVito | |

(Continued)

FOREIGN PATENT DOCUMENTS

JP 2001-145511 A 5/2001

(Continued)

OTHER PUBLICATIONS

Notification of Transmittal of the International Search Report and The Written Opinion of the International Searching Authority, Or the Declaration, PCT/US2010/050726, Jul. 1, 2011, Korean Patent Office, International Searching Authority.

*Primary Examiner* — Noah Chandler Hawk

(74) *Attorney, Agent, or Firm* — DuFault Law Firm, P.C.; Dustin R. DuFault

(57) ABSTRACT

The present invention includes a walking cane having a handle assembly, a support assembly and foot member. The handle assembly includes first and second generally upright rigid posts. A shaft adaptable for grasping by a user's hand connects to each end of the posts. Pliable mounts dispose between the terminal ends of the shaft and each post. The mounts, biased against the shaft, permit omni-directional movement of the shaft relative to each post. The support assembly connects to the handle assembly and includes three parallel elongated rods spaced apart from one another in a triangular formation. The handle assembly can be adjusted relative to the support assembly by means of two cooperating shims. The foot member connects to the support assembly and contacts the ground. The cane provides a light-weight shaft and a shock absorbing handle assembly to assist in relieving hand, wrist and arm strains.

15 Claims, 6 Drawing Sheets

U.S. PATENT DOCUMENTS

| | | | | | |
|---|---|---|---|---|---|
| 4,061,347 | A | | 12/1977 | Stern et al. | |
| 4,121,605 | A | | 10/1978 | Schmerl | |
| 4,572,227 | A | | 2/1986 | Wheeler | |
| 4,609,055 | A | * | 9/1986 | Grafstrom et al. | 173/162.2 |
| 4,708,154 | A | | 11/1987 | Edwards | |
| 4,730,632 | A | | 3/1988 | Mace | |
| 4,796,648 | A | | 1/1989 | Goulter | |
| 4,958,651 | A | | 9/1990 | Najm | |
| 5,168,601 | A | * | 12/1992 | Liu | 16/445 |
| 5,301,704 | A | | 4/1994 | Brown | |
| 5,699,819 | A | | 12/1997 | Simons | |
| 5,711,334 | A | * | 1/1998 | Roux | 135/65 |
| 5,720,474 | A | | 2/1998 | Sugiyama | |
| 5,901,724 | A | * | 5/1999 | Andrea et al. | 135/69 |
| 5,904,167 | A | | 5/1999 | Moye | |
| 6,055,998 | A | | 5/2000 | Bader | |
| 6,488,042 | B2 | | 12/2002 | Troyer | |
| 6,668,846 | B2 | | 12/2003 | Meador | |
| 6,883,530 | B2 | | 4/2005 | Kawakami | |
| D547,542 | S | | 7/2007 | Vellrath | |
| 7,270,138 | B2 | | 9/2007 | Liao | |
| 7,445,016 | B1 | | 11/2008 | Ortiz | |
| 7,503,337 | B1 | | 3/2009 | Morgan et al. | |
| 7,591,275 | B2 | | 9/2009 | Baker | |
| 2004/0025924 | A1 | | 2/2004 | Garza, Sr. et al. | |
| 2004/0177873 | A1 | | 9/2004 | Coakley, Sr. | |
| 2008/0173340 | A1 | | 7/2008 | Robbins | |

FOREIGN PATENT DOCUMENTS

| | | | |
|---|---|---|---|
| KR | 10-2001-0074239 | A | 8/2001 |
| KR | 10-0822716 | B1 | 4/2008 |
| KR | 10-0825189 | B1 | 4/2008 |
| WO | 98-00043 | A1 | 1/1998 |

* cited by examiner

FIG 5
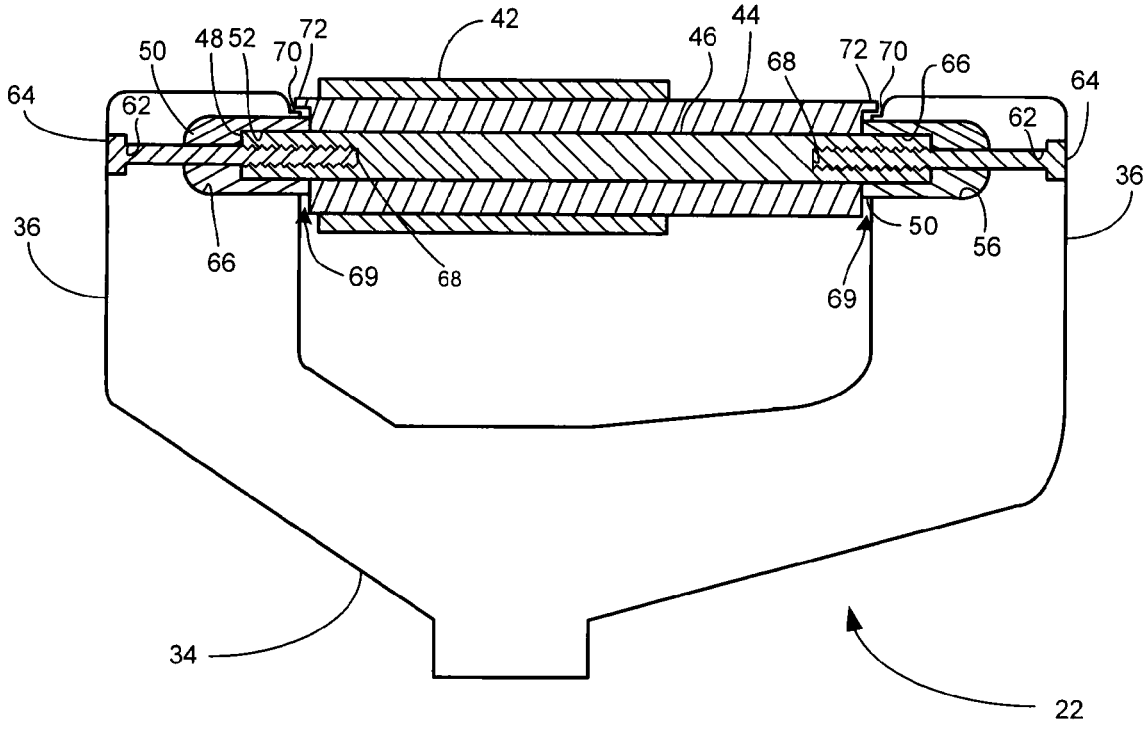
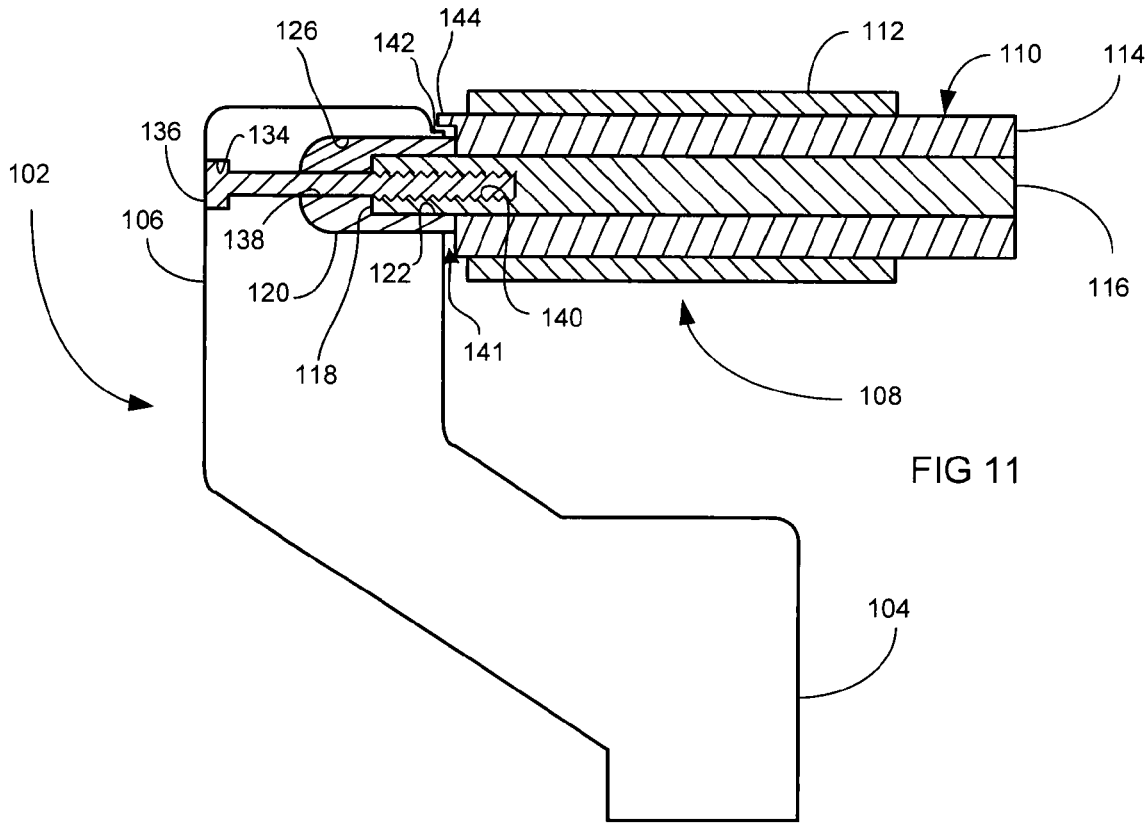
FIG 11

FIG 6
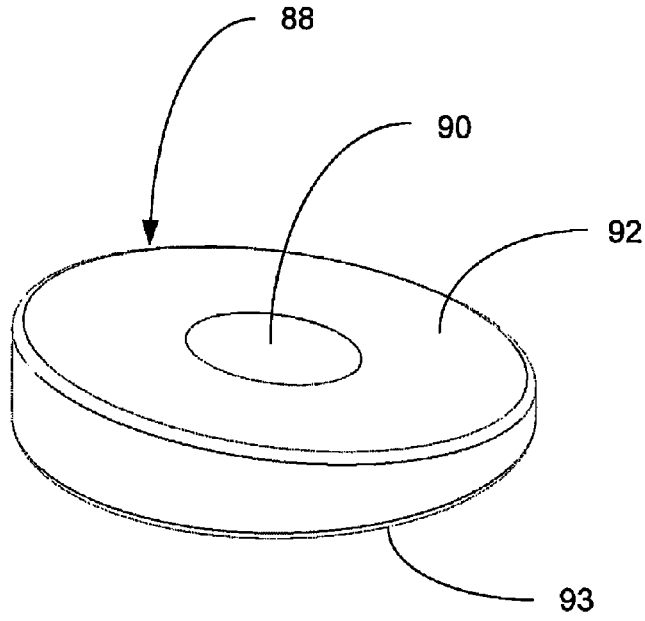
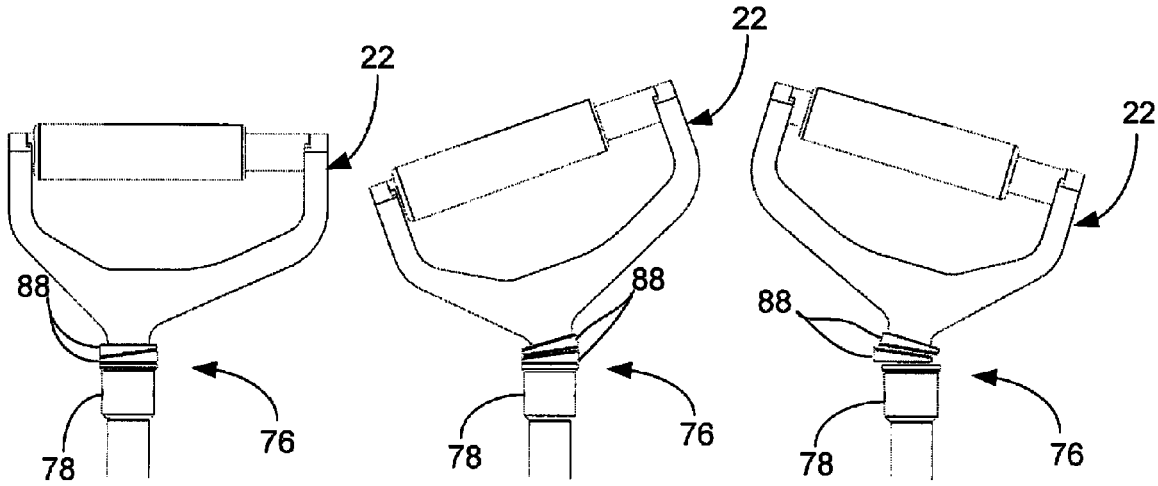
FIG 7a FIG 7b FIG 7c

WALKING CANE

CROSS-REFERENCE TO RELATED APPLICATION(S)

This application claims the benefit of U.S. Provisional Patent Application No. 61/246,776 entitled WALKING CANE, filed on 29 Sep. 2009, which is hereby incorporated herein by reference.

BACKGROUND OF INVENTION

The present invention is generally directed at ambulatory devices. More particularly, the present invention is directed at a walking aid having improved ergonomics, strategic shock absorption properties, and a lightweight multi-structural shaft.

Walking is an important function in everyday life, even over short distances. Without the aid of ambulatory devices, many individuals have a difficult, if not an impossible, time of moving one's self even within the confines of their own home. As of 2008, an estimated 12 million people in the United States reported at least some mobility difficulty. Many of these individuals include senior citizens, whose population is ever drastically increasing as "baby boomers" begin to enter their later stages of life.

There exist in the prior art numerous examples of ambulatory devices such as walking canes, walking sticks, crutches and the like which aid in providing stability to persons requiring assistance when walking or standing. Generally, though, conventional walking canes contain a fixed design which imposes excessive stress on the user's hands, wrists and triceps, resulting in associated shoulder and back strain caused by gait compensation. Conventional cane shafts also have the deleterious effect of providing stiff repetitive shock to hands and arms as weight is applied to the cane, resulting in painful fatigue through frequent use. Such strains may be exacerbated by the repetitive motion necessary to walk even short distances, as well as the associated impact stresses transmitted through the cane and to the user when engaging the tip with the ground.

There presently exists a need in providing a durable walking cane to overcome the aforementioned obstacles. Such a walking aid would diminish excessive stress applied to the hands and wrists during its use, thereby decreasing gait compensation to reduce the occurrence of shoulder and back strain. An object of the present invention would therefore include providing a light-weight cane having an improved shaft and handle construction to achieve the aforementioned goals.

BRIEF SUMMARY OF INVENTION

The present invention overcomes the deficiencies of the prior art in several of its embodiments. It is therefore an object of the present invention to provide a walking cane or crutch including a non-stationary, shock absorbing handle assembly to assist in relieving hand, wrist and arm strains. In one embodiment, the handle assembly comprises a closed configuration having opposing first and second upright posts. The posts carry a grip biased by first and second pliable mounts held in place under tension by a fastening mechanism. The mounts act as shock absorbers and permit the grip to have limited omni-directional movement relative to each post.

In another embodiment, the handle assembly comprises an open configuration having a generally upright post, a grip connectable substantially orthogonal to the post, and a pliable mount engageable with the post and the grip. A fastening mechanism secures the grip and the mount to the post, thereby biasing mount against the grip. The mount acts as a shock absorber and permits the grip to have limited omni-directional movement relative to the post.

In another embodiment, a pliable mount is positioned between the handle assembly and a vertical support. The mount acts as shock absorbers and permits the handle assembly to have limited omni-directional movement relative to the vertical support.

It is also an object of the present invention to provide a walking cane having a tilting handle assembly so that the handle assembly can be adjusted to produce ergonomically optimized loading positions for the hand and wrist, even on an individualized need. In one embodiment, the handle assembly is selectively positionable relative to a vertical support by providing first and second shims cooperably engaged with on another. The shims are preferably positioned between the handle assembly and the vertical support. The orientation of the handle assembly relative to the vertical support can be modified by selectively positioning either shim relative to the other.

Another object of the present invention is to provide an extremely lightweight vertical support, durable enough to withstand the force of a person resting, leaning or using the cane as a means of support. In one embodiment, the vertical support includes three parallel elongated rods spaced apart from one another in a triangular position. Triangular brackets attach to the rods to prevent flexation thereof when a load is applied to the walking device.

BRIEF DESCRIPTION OF THE DRAWINGS

FIG. 5 is a cross-sectional view of the handle assembly in accordance with the first embodiment of the present invention as taken along lines A-A in FIG. 3.

FIG. 6 is a perspective view of a shim as used in accordance with a neck assembly of the present invention.

FIGS. 7*a*, 7*b* and 7*c* illustrate selected orientations of the handle assembly in accordance with the present invention.

FIG. 11 is a cross-sectional view of the handle assembly in accordance with the second embodiment of the present invention as taken along lines B-B in FIG. 9.

DETAILED DESCRIPTION

Figure 1:
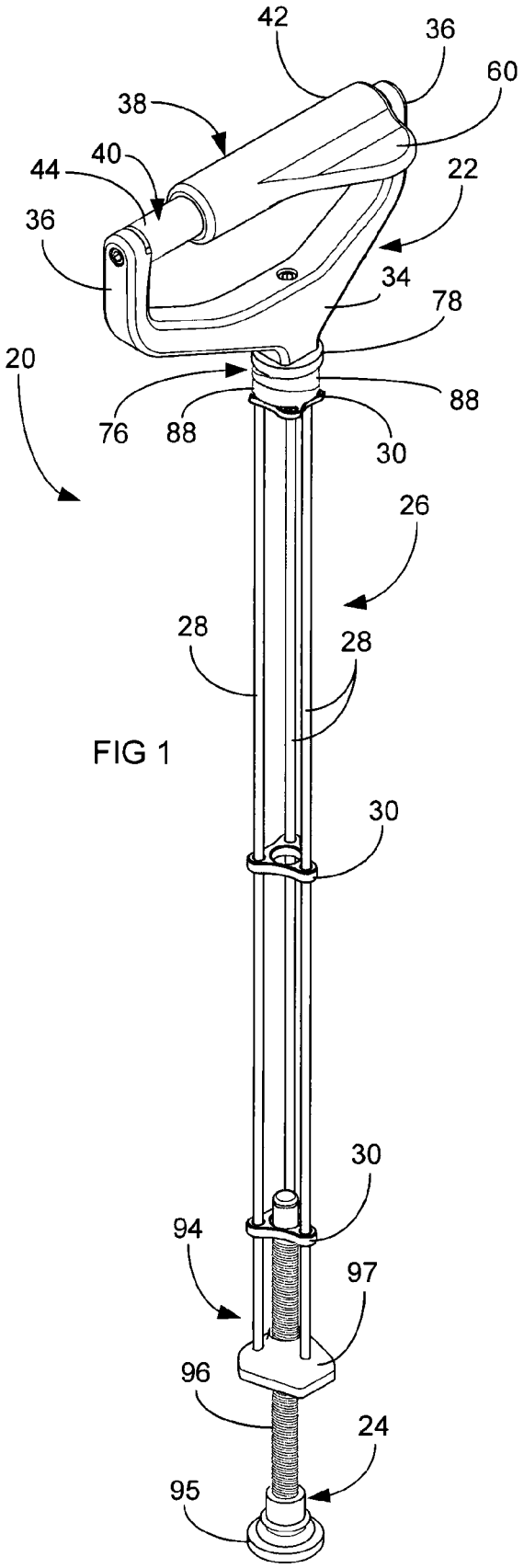
FIG. 1 is perspective view of a first embodiment of a walking cane of the present invention.
Figure 2:
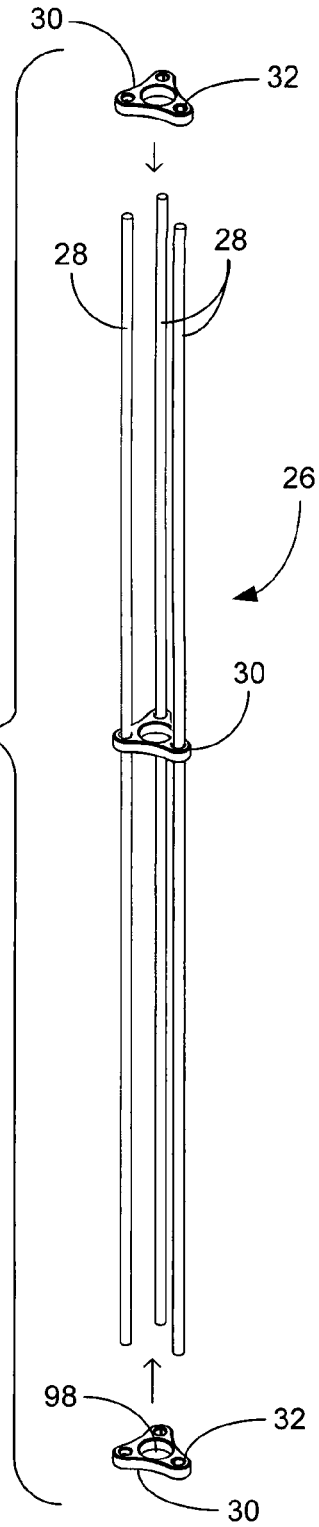
FIG. 2 is a perspective view of a vertical support for use in the walking cane of the present invention.

A first embodiment of a walking cane according to the present invention is generally indicated at 20 in FIG. 1. While the present description uses the term cane throughout, it should be noted that that term is meant to include a multiplicity of walking aids or ambulatory devices, including crutches and walkers. The walking cane 20 generally includes a handle assembly 22 and a ground engaging assembly 24, each connected to a vertical support assembly 26. As illustrated in FIG. 2, the vertical support assembly 26 includes three elongated rods 28 spaced-apart in a preferably triangular fashion. Each rod 28 is preferably constructed from a light-weight, high tensile strength material, for example carbon fiber composite. However, similar suitable materials for the construction of the rods 28 are well within the scope of the present invention, including aluminum, magnesium, titanium, advanced high-strength steels, fiber-reinforced composites, and metal matrix composites. It has been discovered that by replacing the single shaft support of the prior art with three spaced-apart rods 28 placed in triangular formation, ease of maneuverability is greatly improved and the overall weight of the cane 20 is reduced while maintaining, if not improving, the overall structural integrity of the cane 20. It should be noted, though, that it is well within the scope of the present invention to include additional rods 28 in other formations, including a square formation, pentagonal, hexagonal, heptagonal, octagonal formations as well. It is also within the scope of the present invention to provide hollow tubes instead of solid rods. The rods 28 are held in fixed relation to one another by a series of stabilizing brackets 30. Each bracket 30 includes a generally triangular configuration having an aperture 32 positioned at each vertex. These apertures 32 are sized for receiving each rod 28 so that the brackets 30 may be permitted to be positionable along the length of support assembly 26 during the construction thereof, but at the same time providing a snug fit such that the bracket 30 can be retained at any selected position. After proper positioning, each bracket 30 can be adhered into place, for example with the application of an adhesive. As illustrated in FIG. 2, three brackets 30 are utilized to retain the rods 28 in fixed relation to one another. It should be noted, though, that it is well within the scope of the present invention to provide additional brackets 30, and also that as few as a single bracket 30 may be provided. Each bracket 30 is preferably of unitary construction, molded from suitable plastic, metal, or composite material, such as carbon fiber or Delrin® as made commercially available by E.I. Du Pont de Nemours and Company of Wilmington, Del., as is known in the art.

Figure 3:
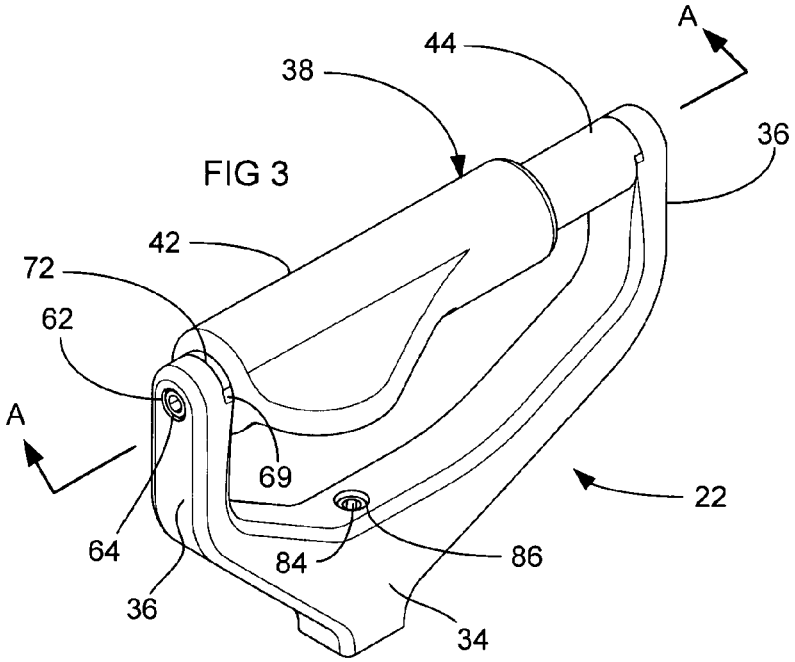
FIG. 3 is a perspective view of a handle assembly in accordance with the first embodiment of the present invention.
Figure 4:
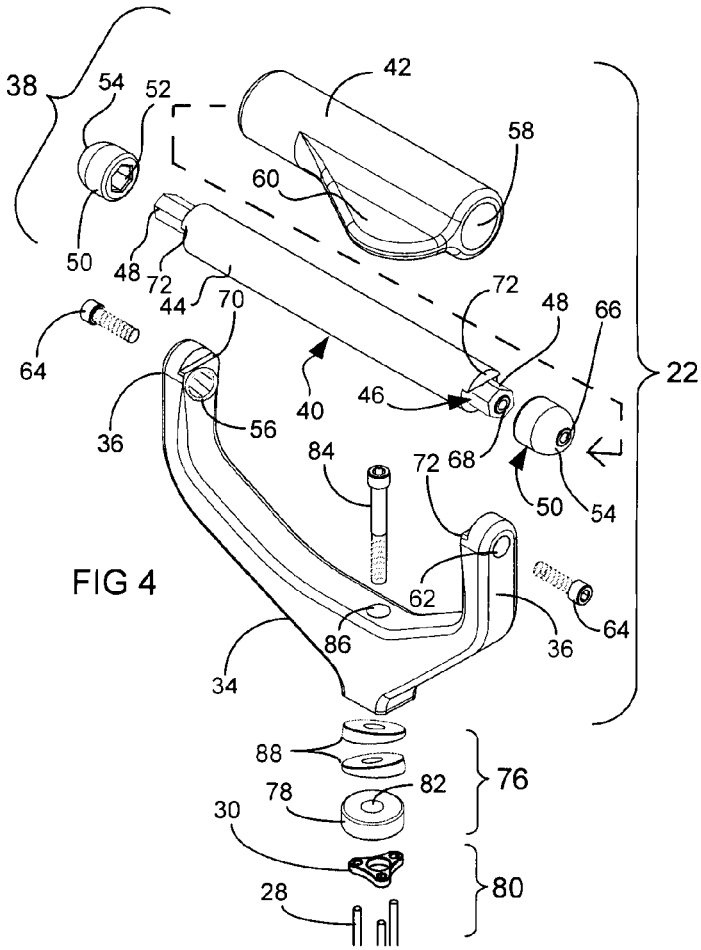
FIG. 4 is an exploded view of the handle assembly in accordance with the first embodiment of the present invention.

As illustrated in FIGS. 3 and 4, the handle assembly 22 includes a base 34 having opposing substantially upright posts 36 for supporting a grip assembly 38. By substantially upright it is meant that the posts 36 extend generally perpendicularly upward from the lengthwise plane of the base 34, but may deviate therefrom up to 90 degrees in either direction and still be within the scope of the present invention. The base 34 and posts 36 are preferably of unitary construction, but it is well within the scope of the present invention to attach the posts 36 to the base 34 as separate pieces. It is also within the scope of the present invention to provide the base 34 and posts 36 in two separate halves which are joined together at a center portion of the base 34. The base 34 and posts 36 are preferably molded from plastic or other suitable composite material which provides for lightweight and durable support, such as Delrin® as made commercially available by E.I. Du Pont de Nemours and Company of Wilmington, Del. Again, the use of any lightweight, high-strength material is well within the scope of the present invention, including aluminum, magnesium, titanium, advanced high-strength steels, fiber-reinforced composites, and metal matrix composites.

The grip assembly 38 includes a cross member 40 adapted to contain a grip 42. The cross member 40, which is generally cylindrical in shape, preferably includes a layer of composite plastic 44 molded over an inner metallic shaft 46. Terminal ends 48 of the shaft 46 extend beyond the molded layer 44 for supporting pliable mounts or dampeners 50. The mounts 50 are configured to receive the respective terminal end 48 within a recessed cavity 52. Each recessed cavity 52 may include a corresponding shape, in this example hexagonal, to receive the respective terminal end 48 in a specific orientation. It should be noted, though, that alternate shapes of each terminal end 48, and of the corresponding cavity 52 of the mount 50, are within the scope of the present invention and include, but are not limited to, circular, oval, square, pentagonal, heptagonal and octagonal configurations. An opposing frusto-conical or semi-spherical portion 54 of each mount 50 seats within a corresponding cavity 56 contained within each upright post 36, which facilitates in securing the grip assembly 38 to the base 34.

The grip 42, preferably constructed from a pliant material such as silicone, includes an inner core 58 disposable over the molded layer 44 for attachment to the cross member 40. The grip 42 may optionally contain a layer of memory foam (not shown) to enhance the comfort thereof when grasped by a user. The grip 42 also contains a webbing support 60 partially extending from an outer surface. To increase comfort, the webbing support 60 is designed to accept a portion of a user's palm, thumb, and the heel and webbing of the hand, to provide greater load-bearing surface area to reduce pressure applied to the user's hand. The webbing support 60 may be configured for a left-handed user, as illustrated in FIG. 3, or a right-handed user, as illustrated in FIG. 4. The webbing support can also be selectively positioned for use with both left-handed and right-handed users.

To secure the grip assembly 38 to the base 34, each post 36 contains an aperture 62 for receiving a male threaded fastener 64 therethrough. Each mount 50 contains a corresponding aperture 66 for receiving the fastener 64, and each terminal end 48 of the cross member 40 contains a female threaded internal bore 68. Upon disposing the fastener 64 through the respective post 36 and mount 50, the fastener 64 threadably engages with the corresponding terminal end 48 of the shaft 46. Upon further tightening the fastener 64, each mount 50 seating within the respective post cavity 56 compresses under tension, frictionally engaging the grip assembly 38 to the posts 36 while at the same time allowing limited omni-directional movement of the grip assembly 38 relative to the base 34 and posts 36. By omni-directional it is meant that the grip assembly 38 is permitted limited movement within six degrees of freedom, including heaving, swaying, surging, pitching, yawning and rolling.

As illustrated in FIG. 5, to permit the omni-directional movement of the grip assembly 38, the length of the cross member 40 is slightly less than the distance between the posts 36 while under tension, providing a gap 69 between the cross member 40 and the inner surface of each post 36. Also, to prevent excess torsional movement of the grip assembly 38 when excessive torsional force is applied to the webbing support 60, each post 36 may contain an optional ledge 70 positioned on an inner surface thereof which engages a corresponding outcropping 72 contained on the cross member 40. The pliant mounts 50 allow the grip assembly 38 a limited range of movement relative to the base 34, including translational movement in a three-dimensional plane, as well pivotal pitch, roll and yaw movement. The mounts 50 further act as shock reducers, absorbing both impact stresses transmitted through the cane 20 from contact with the ground, as well as movement applied to the handle assembly 22 by the user.

Connecting the handle assembly 22 to the support assembly 26 is accomplished by means of a neck assembly 76. The neck assembly 76 includes a circular mounting cap 78 which is positionable over and attached to the upper portion 80 of the support assembly 26, wherein a top bracket 30 and the rods 28 preferably seat therein and are adhered to the cap 78. Alternatively, the cap 78 can be configured to have separate apertures (not shown) for receiving the upper terminal end of each rod 28 which are journaled therein. The mounting cap 78 contains a centrally located female threaded aperture 82 for receiving a male threaded fastener 84. The fastener 84 is disposable through an aperture 86 located in the central portion of the base 34 to threadably engage the cap 78, thereby securing the handle assembly 22 to the support assembly 26. The cap 78 may be constructed of a pliant material which further acts as a shock absorber, reducing or eliminating impact stresses transmitted through the tip assembly 24 and support assembly 26 to the handle assembly 22 from contact with the ground.

The neck assembly 76 may further include mateable shims 88 which allow for the selectively angled positioning of the handle assembly 22 relative to the support assembly 26. As illustrated in FIG. 6, an exemplary shim 88 contains a central bore 90 for disposing the fastener 84 therethrough. Each shim 88 also contains a first angled surface 92 on one side, and a level surface 93 on the opposing side. The shims 88 are engaged with one another, preferably such that the angled surfaces 92 contact each other. As illustrated in FIGS. 7*a*, 7*b* and 7*c*, the shims 88 can be rotated relative to one another such that the pitch and roll of the handle assembly 22 relative to the support assembly 26 can be selectively positioned. Such adjustment may be especially desirable if the user has some malady which makes it difficult in grasping a cane in a conventional fashion. As illustrated in FIG. 7*a*, the shims 88 are adjusted so that the grip assembly 38 is a substantially parallel with the ground when the cane 20 is in an upright position. As illustrated in FIG. 7*b*, the top shim 88 has been positioned to adjust the pitch and roll of the handle assembly 22 relative to the support assembly 26. As illustrated in FIG. 7*c*, both shims 88 have been positioned to adjust the pitch and roll of the handle assembly 22 relative to the support assembly 26.

Referring back to FIG. 1, a bottom portion 94 of the support assembly 26 connects to the ground engaging assembly 24. The ground engaging assembly 24 generally includes a foot pad 95 connected to a threaded rod 96. The rod 96 disposes within a housing 97 attached to the support assembly 26 and containing a threaded burr (not shown). By rotating the threaded rod 96, the overall length of the cane 20 be adjusted. The bracket 30 includes a central aperture 98 so that the threaded rod 96 can be disposed therethrough. This allows the bracket 30 to be positioned to stabilize the lower portion 94 of the support assembly 26 without interfering with the ground engaging assembly 24. Those skilled in the art should recognize that other known ground engaging assemblies can be employed with the present invention, including fixed length assemblies, locking assemblies and the like.

In initially setting up the walking cane 20 for a specific user, the user can customize the cane 20 by adjusting its height (if the ability to do so is available), as well as adjust the pitch and yaw of the handle assembly 22 by loosening the fastener 84 and selectively positioning the shims 88. Upon attaining the desired position of the handle assembly 22, the fastener 84 is tightened to lock the handle assembly 22 in place. Selective rotational positioning of the handle assembly 22 can also be accomplished in this manner if a directional foot is used.

Figure 8:
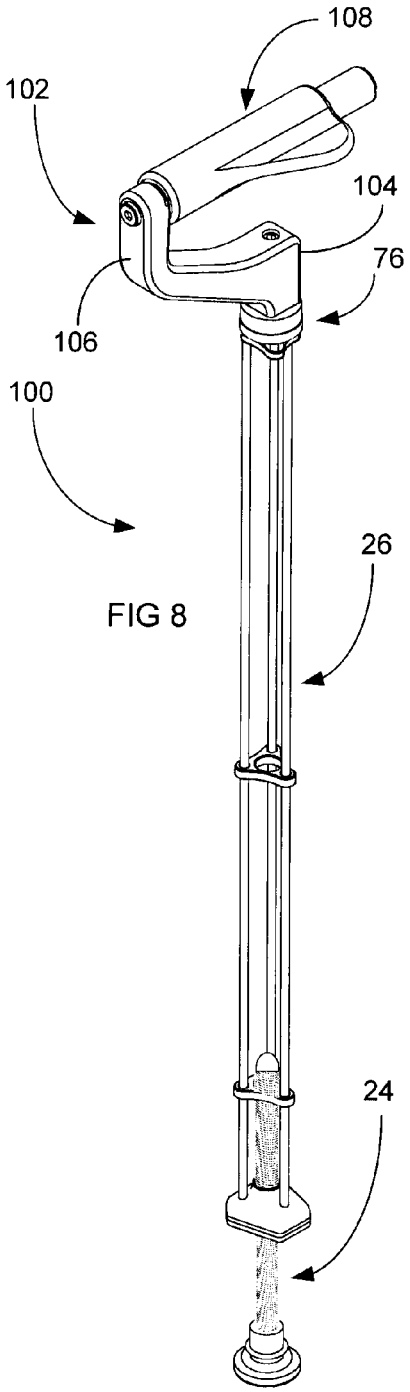
FIG. 8 is a perspective view of a second embodiment of the walking cane of the present invention.
Figure 9:
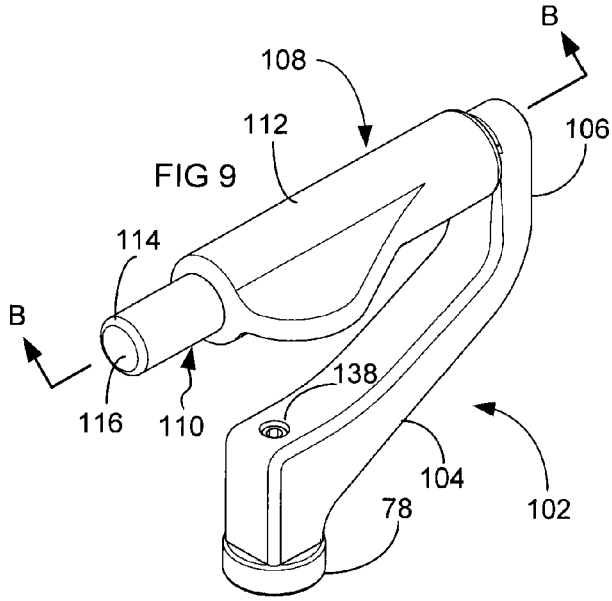
FIG. 9 is a perspective view of a handle assembly in accordance with the second embodiment of the present invention.
Figure 10:
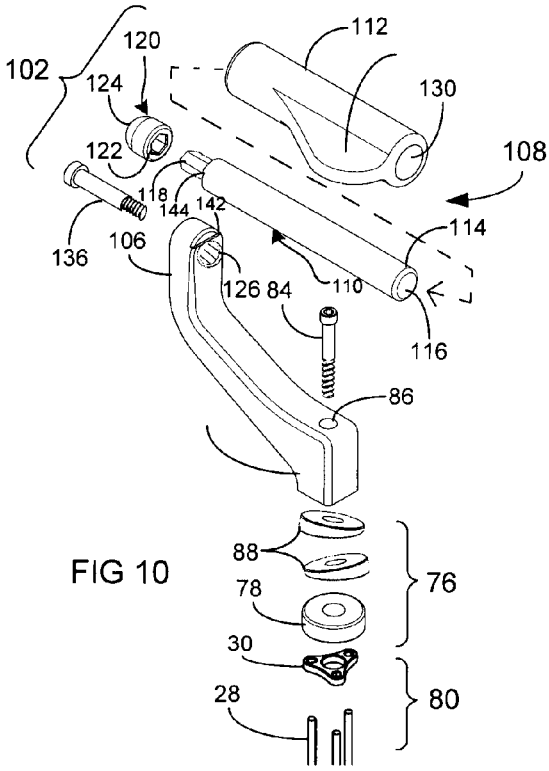
FIG. 10 is an exploded view of the handle assembly in accordance with the second embodiment of the present invention.

Referring now to FIGS. 8, 9 and 10, a second embodiment of a walking cane of the present invention is indicated at 100. The second embodiment 100 contains all the features of the first embodiment 20, with the exception that a handle assembly 102 now employs an open design. As such, like references in the description of the second embodiment correspond with similar parts of the first embodiment. As illustrated in FIGS. 9, 10 and 11, the handle assembly 102 includes a base 104 having a substantially upright post 106 for supporting a grip assembly 108. By substantially upright it is meant that the post 106 extends generally perpendicularly upward from the lengthwise plane of the base 104, but may deviate therefrom up to 90 degrees in either direction and still be within the scope of the present invention. The base 104 and post 106 are preferably of unitary construction, but it is well within the scope of the present invention to attach the post 106 to the base 104 as separate pieces. The base 104 and post 106 are preferably molded from plastic or other suitable composite material which provides for lightweight and durable support, such as Delrin® as made commercially available by E.I. Du Pont de Nemours and Company of Wilmington, Del. Again, the use of any lightweight, high-strength material is well within the scope of the present invention, including aluminum, magnesium, titanium, advanced high-strength steels, fiber-reinforced composites, and metal matrix composites.

The grip assembly 108 includes a cantilevered member 110 adapted to contain a grip 112. The cantilevered member 110, which is generally cylindrical in shape, preferably includes a layer of composite plastic 114 molded over an inner metallic shaft 116. A proximal end 118 of the shaft 116 extends beyond the molded layer 114 for supporting a pliable mount or dampener 120. The mount 120 is configured to receive the proximal end 118 within a recessed cavity 122. The recessed cavity 122 may include a corresponding shape, in this example hexagonal, to receive the proximal end 118 in a specific orientation. It should be noted, though, that alternate shapes of the proximal end 118, and of the corresponding cavity 122, are within the scope of the present invention and include, but are not limited to, circular, oval, square, pentagonal, heptagonal and octagonal configurations. An opposing frusto-conical or semi-spherical portion 124 of the mount 120 seats within a cavity 126 contained within the upright post 106, which facilitates in securing the grip assembly 108 to the base 104.

The grip 112, preferably constructed from a pliant material such as silicone, includes an inner core 130 disposable over the molded layer 114 for attachment to the cantilevered member 110. The grip 112 may also contain a layer of memory foam (note shown) to enhance the comfort thereof when grasped by a user. The grip 112 also contains a webbing support 132 partially extending from an outer surface. To increase comfort, the webbing support 132 is designed to accept a portion of a user's palm and thumb, and the webbing of the hand therebetween, to provide greater load-bearing surface area to reduce pressure applied to the user's hand. The webbing support 132 may be configured for a left-handed user, as illustrated in FIGS. 8 and 10, or a right-handed user, as illustrated in FIG. 9. The webbing support 132 can also be selectively positioned for use with both left-handed and right-handed users.

To secure the grip assembly 108 to the base 104, the post 106 contains an aperture 134 for receiving a male threaded fastener 136 therethrough. The mount 120 also contains a corresponding aperture 138 for receiving the fastener 136, and the proximal end 118 contains a female threaded internal bore 140. Upon disposing the fastener 136 through the post 106 and mount 120, the fastener 136 threadably engages with the proximal end 118 of the shaft 116. Upon further tightening the fastener 136, the mount 120 seats within the post cavity 126 and compresses under tension, frictionally engaging the grip assembly 108 to the post 106, while at the same time allowing limited omni-directional movement of the grip assembly 108. By omni-directional it is meant that the grip assembly is permitted limited move within six degrees of freedom, including heaving, swaying, surging, pitching, yawning and rolling.

To permit the omni-directional movement of the grip assembly 108, a small gap 141 exists between the cantilevered member 110 and the inner surface of post 106, as best illustrated in FIG. 11. To prevent excess torsional movement of the grip assembly 108 when excessive torsional force is applied to the webbing support 132, the post 106 may contain an optional ledge 142 positioned on an inner surface thereof to receive a corresponding outcropping 144 contained on the cantilevered member 110. The pliant mount 120 allows the grip assembly 108 a limited range of pitch, yaw and roll movement relative to the base. The mount 120 further acts as a shock reducer, absorbing both impact stresses transmitted through the cane from contact with the ground, as well as movement applied to the handle assembly 102 by the user.

Similar to the first embodiment 20, the handle assembly 102 connects to the support assembly 26 by means of the neck assembly 76. The handle assembly 102 is therefore positionable relative to the support assembly 26 through use of the shims 88 in the same manner as previously described. However, and as illustrated in FIG. 9, the neck assembly may only consist of the cap member 78.

Figure 12:
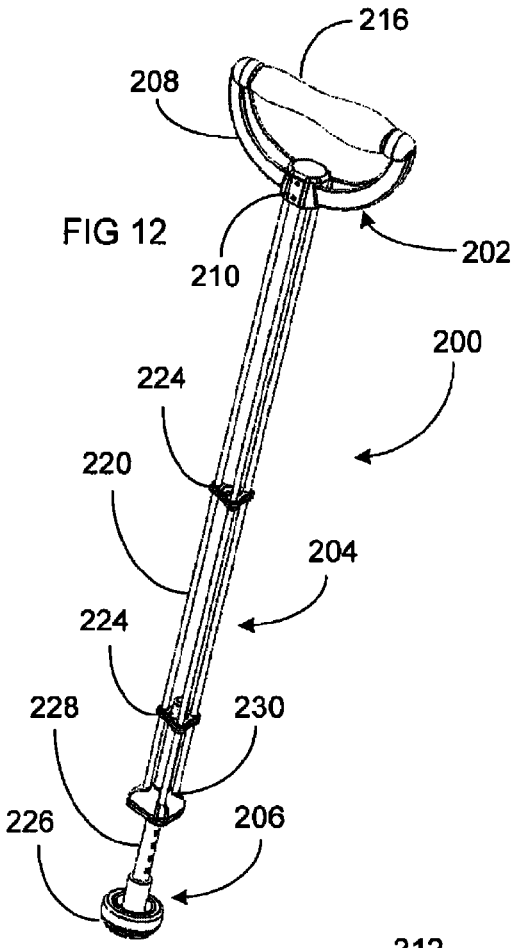
FIG. 12 is a perspective view of an alternative embodiment of the walking cane in accordance with the present invention.
Figure 14:
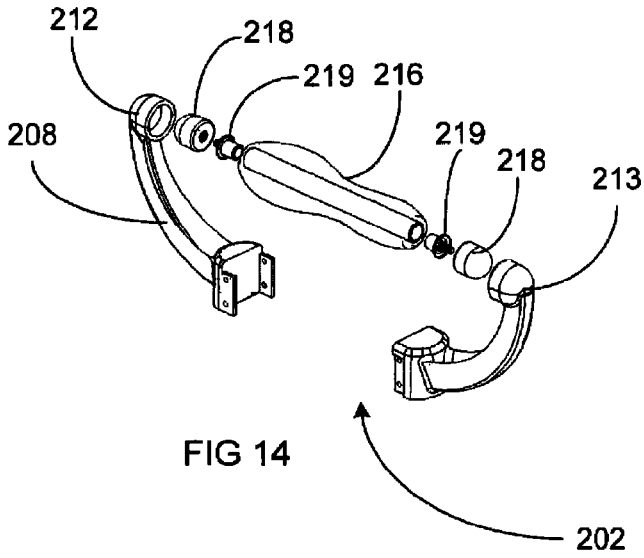
FIG. 14 is an exploded view of and alternative handle assembly in accordance with the alternative embodiment of the present invention.
Figure 13:
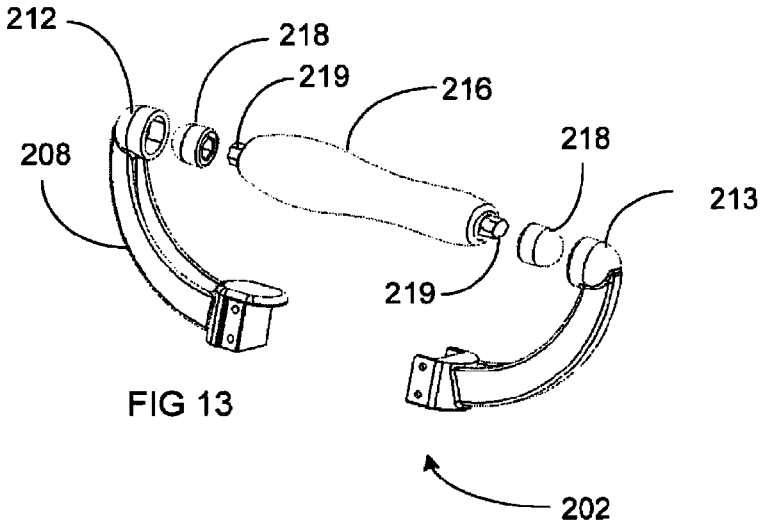
FIG. 13 is an exploded view of a handle assembly in accordance with the alternative embodiment of the present invention.

Turning now to FIG. 12, an alternative embodiment of the walking cane of the present invention is generally depicted at 200. The walking cane 200 includes a handle portion 202 connected to a multi-member shaft portion 204 to which is attached a tip portion 206. The handle portion 202 includes a parabolic saddle-shaped member 208 connected to the shaft portion 204 by a connecting assembly 210. The design of the handle is such that the user's force from when walking is always directed in the most efficient way toward the central support of the shaft. No matter which angle the user uses to orient the cane to the ground while walking, the symmetrical fork-shaped handle directs the physical "load" to the shaft. This eliminates the need for the "offset" angle commonly used in conventional canes to solve this problem. Referring to FIGS. 13 and 14, each end 212, 213 of the saddle member 208 is designed to receive respective terminal ends 214 of a handle 216. Each terminal end 214 of the handle 216 includes a compressible member 218 which seats within the respective end 212, 213 to secure the handle 216 to the saddle member 208. Each compressible member 218 is designed to be slightly positionable relative to the saddle-shaped member 208 in order to permit the handle 216 to adjust its position when a user grips the handle 216 and positions the cane 200 to support the user's weight thereon. As such, regardless the orientation of the cane 200 relative to the ground, the positionability of the handle 216 enables greater relaxation and relief of stress upon the user' hand, wrist, arm and elbow. This unique anti-shock system utilizes a cylinder or sphere made of compressible foam or silicone materials. A horizontal dowel-type rod 219 structure inside the grip extends beyond the grip into the center of these shock absorbers. Because the dowel from the grip is now surrounded by shock absorbing materials at each end, the shock absorption is omni-directional in that shock protection is afforded no matter which angle the user orients the cane to the ground. Further, the compressibility of each member 218 also absorbs shock forces transferred through the cane 200 during the repetitive engagement and disengagement of the tip portion 206 with the ground while the user is walking with the cane 200.

Moreover, the handle 216 is ergonomically designed to provide an optimized gripping surface to further reduce stresses on the hand, wrist, arm and shoulder to relieve pain and fatigue. In so doing, the ergonomic handle 216 moves the primary point of stress and force from the weak, bony parts of the hand and wrist to the strong, "meaty" parts. The ergonomic handle 216 enables the hand, wrist and arm to be oriented in such a way as to provide maximum strength and minimal strains to the forearm, elbow, back and shoulder. The shape of the handle 216 provides surer, more comfortable gripping area for the thumb and forefinger, and also moves the main stress point away from the bony part of the hand to the meatier palm and heel areas.

The shaft portion 204 includes a plurality of elongated members 220. Each elongated member 220 may consist of a hollow tube, for example a ¼ inch tube, or a solid rod, for example a ⅛ inch rod. The construction of either the tube or the rod preferably includes a light-weight material exhibiting a high tensile strength. Such suitable materials include, but are not limited to, carbon graphite and aluminum. Preferably three rods 220 are implemented and spaced apart at each terminal end thereof, and at an approximate midsection by a spacer 224. It should be noted, though, that a different number of elongated members 220, or a differing positioning thereof, is well within the scope of the present invention. By providing a plurality of lightweight elongated members 220 exhibiting high tensile strength, the overall weight of the cane 200 is drastically reduced without decreasing, and in some cases increasing, the strength of the cane 200.

Positioned at the terminal end of the shaft portion 204 is the tip portion 206. The tip portion 206 includes a member 226 engageable with the ground connected to a rod or tube 228 slidably disposable between the elongated members 220. A flip-lock 230 secures the tip portion 206 relative to the shaft 204 when the tip 226 is at a desired position. The tip portion 206 is thereby positionable to extend or decrease the overall length of the cane 200 to fit the needs of the respective user.

Although the present invention has been described with reference to preferred embodiments, workers skilled in the art will recognize that changes may be made in form and detail without departing from the spirit and scope of the invention.

The invention claimed is:

1. A handle assembly for use with a walking aid comprising:

a generally upright first post;

a first recessed cavity contained on an inner face of the post;

a grip connectable substantially orthogonal to the post, the grip configured for grasping by a user's hand;

a pliable mount engageable with the post and a proximal end of the grip; and a fastening mechanism to secure the grip and the mount to the post, the fastening mechanism biasing the mount against the grip, wherein at least a portion of the mount seats within the first cavity when the mount and grip are secured to the post, wherein the portion of the pliant mount seating within the first recessed cavity includes an outer semi-spherical configuration, wherein the grip is permitted omni-directional movement relative to the post to increase comfort when the user grips the handle to use the walking aid.

2. The device of claim 1 wherein the fastening mechanism comprises a threaded fastener to secure the grip to the post, the post and the mount each including surfaces defining an aperture therethrough, the grip including a threaded bore for receiving a terminal end of the fastener, the terminal end of the fastener disposable through the aperture of the post and the aperture of the mount to threadably engage the bore of the grip, whereupon the grip is biased against the mount.

3. The device of claim 1 further comprising:

a second generally upright rigid post positioned in cooperable relation to the first post, terminal ends of the grip connected to each post; and a second pliable mount disposed between the grip and the second post, wherein the second mount biases against the grip while permitting omni-directional movement of the grip relative to the posts to reduce impact stress and increase user comfort when the user grasps the handle assembly in using the apparatus.

4. The device of claim 1 wherein the grip contains an outcropping extending towards the post and the post contains a corresponding ledge for receiving the outcropping, wherein the amount of omni-directional movement of the grip is limited by the outcropping engaging the ledge.

5. The device of claim 1 and further comprising a second recessed cavity contained within pliant mount for receiving a terminal end of the grip.

6. The device of claim 5 wherein the second recessed cavity includes a flat inner surface extending perpendicular to the inner face of the post, and wherein the terminal end of the grip includes a corresponding outer flat surface, whereupon the second recessed cavity of the pliant mount receiving the terminal end of the grip, the outer flat surface engages the inner flat surface, wherein rotational movement of the grip relative to the post is prevented.

7. A handle assembly for use with a walking aid comprising:

a first generally upright rigid post;

a shaft having a proximal end connected to the first post, the shaft adaptable for grasping by a user's hand;

a first pliable mount disposed between the proximal end of the shaft and the first post, the first mount engaged with the first post and the shaft; and a first recessed cavity contained on an inner face of the first post, wherein the first end of the mount includes a semi-spherical configuration, wherein a first end of the mount at least partially disposes within the cavity when engaged with the first post and the shaft, wherein the first mount permits omni-directional movement of the shaft relative to the first post to increase comfort when the user grips the handle to use the walking aid.

8. The handle assembly of claim 7 and further comprising a threaded fastener to secure the shaft and mount to the post, the post and the mount each including surfaces defining an aperture therethrough, the shaft including a threaded bore for receiving a terminal end of the fastener, the terminal end of the fastener disposable through the aperture of the post and the aperture of the mount to threadably engage the bore of the shaft, whereupon the shaft is urged against the mount.

9. The handle assembly of claim 7 and further comprising:

a second generally upright post positioned in cooperable relation to the first post, a distal end of the shaft connected to the second post; and a second pliable mount disposed between the distal end of the shaft and the second post, the second mount engaged with the second post and the terminal end of the shaft, wherein the second mount permits omni-directional movement of the distal end of the shaft relative to the second post to assist in relieving hand, wrist and arm strains and reduce impact stress when the user grasps the handle assembly in using the walking aid.

10. The handle assembly of claim 9 and further comprising:

a first threaded fastener to secure the proximal end of the shaft and the first mount to the first post, the first post and the first mount each including surfaces defining an aperture therethrough, the proximal end of the shaft including a threaded bore for receiving a terminal end of the first fastener, the terminal end of the first fastener disposable through the aperture of the first post and the aperture of the first mount to threadably engage the bore of the proximal end of the shaft; and a second threaded fastener to secure the distal end of the shaft and the second mount to the second post, the second post and the second mount each including surfaces defining an aperture therethrough, the distal end of the shaft including a threaded bore for receiving a terminal end of the second fastener, the terminal end of the second fastener disposable through the aperture of the second post and the aperture of the second mount to threadably engage the bore of the distal end of the shaft.

11. The device of claim 7 and further comprising a second recessed cavity contained within a second end of the pliant mount, the second recessed cavity for receiving the proximal end of the shaft.

12. The device of claim 11 wherein the second recessed cavity includes a flat inner surface extending perpendicular to the inner face of the upright post, and wherein the proximal end of the shaft includes a corresponding outer flat surface, whereupon the second recessed cavity receiving the proximal end of the shaft the outer flat surface of the shaft engages the inner flat surface of the second recessed cavity, wherein rotational movement of the shaft relative to the upright post is prevented.

13. A handle assembly for use with a walking aid comprising:

a generally upright first post containing a first recessed cavity on an inner face;

a second generally upright rigid post positioned in cooperable relation to the first post, the second post containing a second recessed cavity a cross member extending substantially orthogonal between the first and second posts, the cross member configured for grasping by a user's hand;

a first shock absorber having a first end at least partially disposed within the first recessed cavity and a second end at least partially disposed over a proximal end of the cross member;

a second shock absorber having a first end at least partially disposed within the second recessed cavity and a second end at least partially disposed over an opposing distal end of the cross member; and a fastening mechanism to secure the proximal end of the cross member to the first post and the distal end of the cross member to the second post, wherein the first end of the first and second shock absorbers include a semi-spherical configuration, whereupon securing the cross member to the first and second posts the first shock absorber becomes biased against the proximal end of the cross member and the first post and the second shock absorber becomes biased against the distal end of the cross member and the second post, whereupon the cross member is permitted omni-directional movement relative to the post to increase comfort when the user grips the handle when using the walking aid for walking.

14. The device of claim 13 and further comprising a second recessed cavity contained within the shock absorber for receiving the proximal end of the cross member.

15. The device of claim 14 wherein the second recessed cavity of the shock absorber includes a flat inner surface extending perpendicular to the inner face of the upright post, wherein the proximal end of the cross member includes a corresponding outer flat surface, whereupon the second recessed cavity of the shock absorber receiving the proximal end of the cross member, the outer flat surface of the cross member engages the inner flat surface of the second recessed cavity, wherein rotational movement of the cross member relative to the upright post is limited.

* * * * *